US005409040A

United States Patent [19]

Tomlin

[11] Patent Number: 5,409,040

[45] Date of Patent: Apr. 25, 1995

[54] SPRINGLESS PILOT OPERATED SEQUENCE VALVE

[75] Inventor: Jerry B. Tomlin, Sugar Land, Tex.

[73] Assignee: Koomey Companies International, Inc., Houston, Tex.

[21] Appl. No.: 103,619

[22] Filed: Aug. 9, 1993

[51] Int. Cl.[6] ..... F15B 13/042

[52] U.S. Cl. ..... 137/625.66; 137/906

[58] Field of Search ..... 137/625.66, 906

[56] References Cited

U.S. PATENT DOCUMENTS

| | | | |
|---|---|---|---|
| 3,921,660 | 11/1975 | Kowalski | 137/236.1 |
| 3,993,100 | 11/1976 | Pollard et al. . | |
| 4,011,892 | 3/1977 | Kowalski | 137/625.66 |
| 4,450,869 | 5/1984 | Acker | 137/625.66 X |
| 4,457,489 | 7/1984 | Gilmore | 137/625.66 X |
| 4,467,833 | 8/1984 | Satterwhite et al. | 251/63.4 X |
| 4,601,311 | 7/1986 | Acker | 137/625.66 |
| 4,637,419 | 1/1987 | Hughes | 137/236.1 |
| 4,817,699 | 4/1989 | Barrier et al. | 137/236.1 X |
| 4,848,404 | 7/1989 | Hickok | 137/625.66 X |
| 4,887,643 | 12/1989 | Tomlin et al. | 137/625.66 |
| 5,056,556 | 10/1991 | Nishimoto et al. | 251/333 X |

*Primary Examiner*—Gerald A. Michalsky
*Attorney, Agent, or Firm*—Fulbright & Jaworski

[57] ABSTRACT

A two-position, three-way pilot valve having a hollow spool valve element connected to a valve stem having first and second ends of equal diameter for pressure balancing the valve. A biasing piston engages one end of the valve stem and a pilot piston engages the other end of the valve stem. The pistons may include two piston rings of different diameter for holding the pistons in alignment. The ends of the spool valve element are structurally designed to maximize valve seating without overstressing.

8 Claims, 5 Drawing Sheets

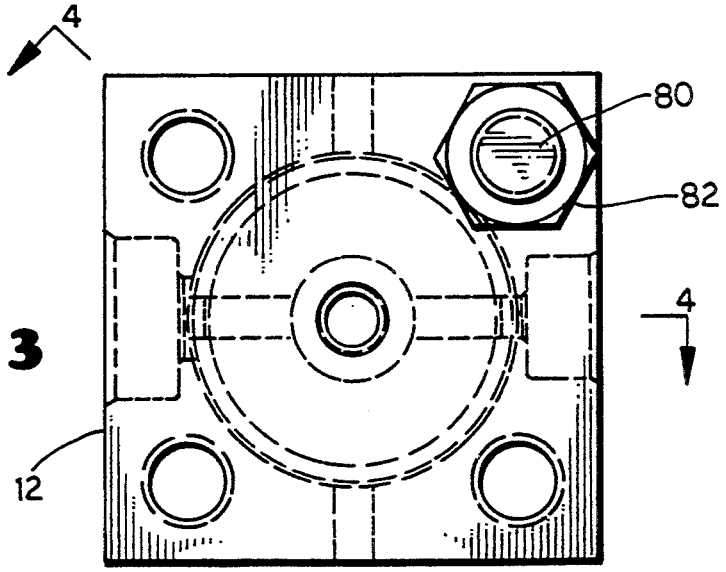
Fig. 3
Fig. 4
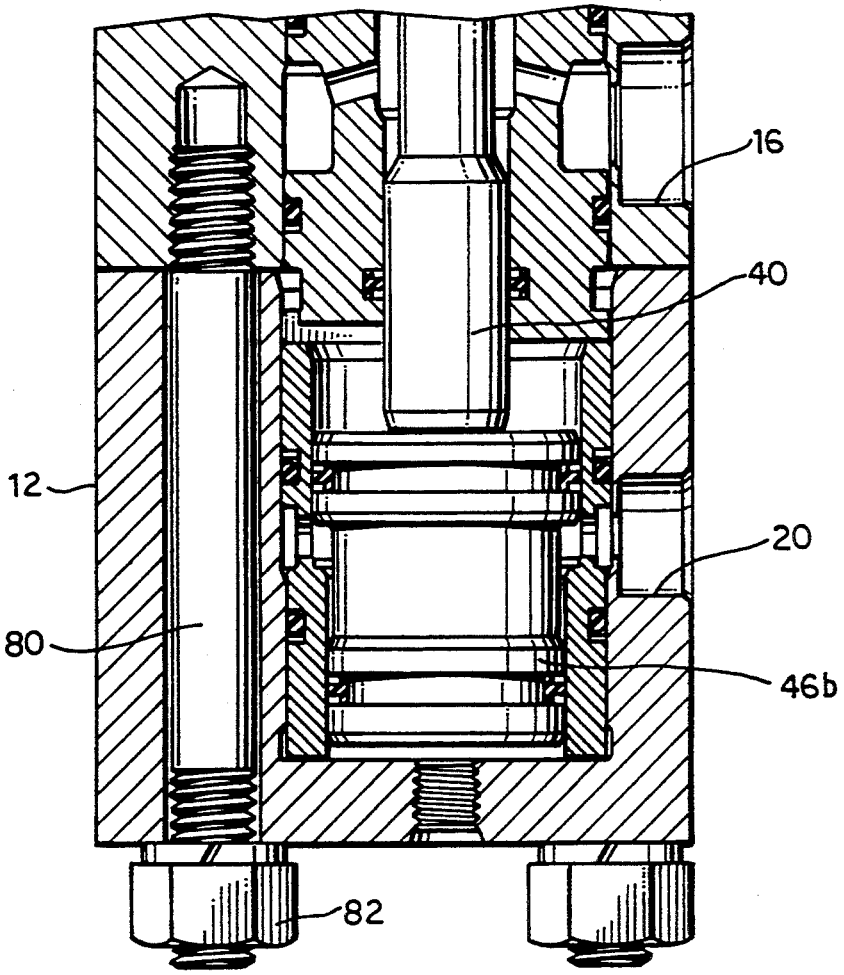

SPRINGLESS PILOT OPERATED SEQUENCE VALVE

BACKGROUND OF THE INVENTION

The present invention is generally directed to a springless pilot operated sequence valve providing a two-position, three-way valve which is particularly useful for controlling a plurality of underwater devices.

As disclosed in U.S. Pat. No. 3,999,100, sequence valves are used in production control system applications for underwater gas and/or oil wells in which a plurality of sequence valves operate in sequence to control multiple tree valves and subsurface safety valves using only a single pilot or signal control line. That is, the functions are operated in a specific sequence, generally by increasing pressure increments on the pilot line for opening a production well. During the process of closing in the well, all of the production valves are closed, generally in the reverse order, by decreasing the pilot pressure in decreased pressure increments. However, currently used sequence valve designs utilize springs. Such springs are under a constant state of compression and over a long period of time the springs lose some of their load capability which changes the operating characteristics of the valve. In addition, while it is desirable to standardize the various sequence valves to some extent, such valves are required to seat and seal at low pressures such as 500 psi, but at the same time the pilot pressure to the system and to all of the valves may increase to a high pressure, such as 3000 psi, which could provide an overstressing of the valve element and valve seat.

The present invention is directed to various improvements in a springless pilot operated sequence valve.

SUMMARY

The present invention is directed to a springless, pilot operated sequence valve which includes a housing having a supply port, an outlet port, an exhaust port, a pilot pressure port and a bias pressure port. A tubular cage is positioned in the housing and has openings in communication with each of the supply port, the output port, and the exhaust port. A hollow spool valve element is telescopically movable in the cage and includes one end for alternately opening and closing the supply port and has another end for alternately opening and closing the exhaust port. A poppet valve seat is carried by the cage adjacent each end of the spool valve for engagement by the spool valve element. A valve stem is connected to the spool valve and has first and second ends of equal diameter which sealably engage the cage on opposite ends of the spool valve for balancing the pressure acting on the stems. A biasing piston in the housing engages one end of the valve stem and is in communication with the bias pressure port, and a pilot piston is positioned in the housing engaging the other end of the valve stem and is in communication with the pilot pressure port.

Another object of the present invention is wherein the biasing piston and the pilot piston each include two piston rings of different diameters for maintaining the pistons in proper axial alignment. In another embodiment, the pistons may include an internal passageway from one end of the piston to an external opening between the piston rings for changing the cross-sectional effective area.

Still a further object of the present invention is wherein the end of the spool valve element opening and closing the supply port includes a tapered, conical face tapering inwardly away from the outside diameter of the spool. Preferably, the end of the spool valve element at the supply port includes a fiat surface at the outside diameter of the spool.

Yet a further object of the present invention is wherein the end of the spool valve element opening and closing the exhaust port includes a face having an internal diameter less than the outside diameter of the spool and includes a tapered, conical face tapering inwardly away from the internal diameter of the face. Preferably, the end of the spool valve element at the exhaust port includes a fiat surface at the inside diameter of the spool, and preferably the end of the spool valve element at the exhaust port end includes an enlarged outside diameter.

Other and further objects, features and advantages will be apparent from the following description of a presently preferred embodiment of the invention, given for the purpose of disclosure, and taken in conjunction with the accompanying drawings.

BRIEF DESCRIPTION OF THE DRAWINGS

FIG. 3 is an end view of the sequence valve of the present invention, FIG. 4 is a cross-sectional view taken along the line 4—4 of FIG. 3.

DESCRIPTION OF THE PREFERRED EMBODIMENT

Figure 1:
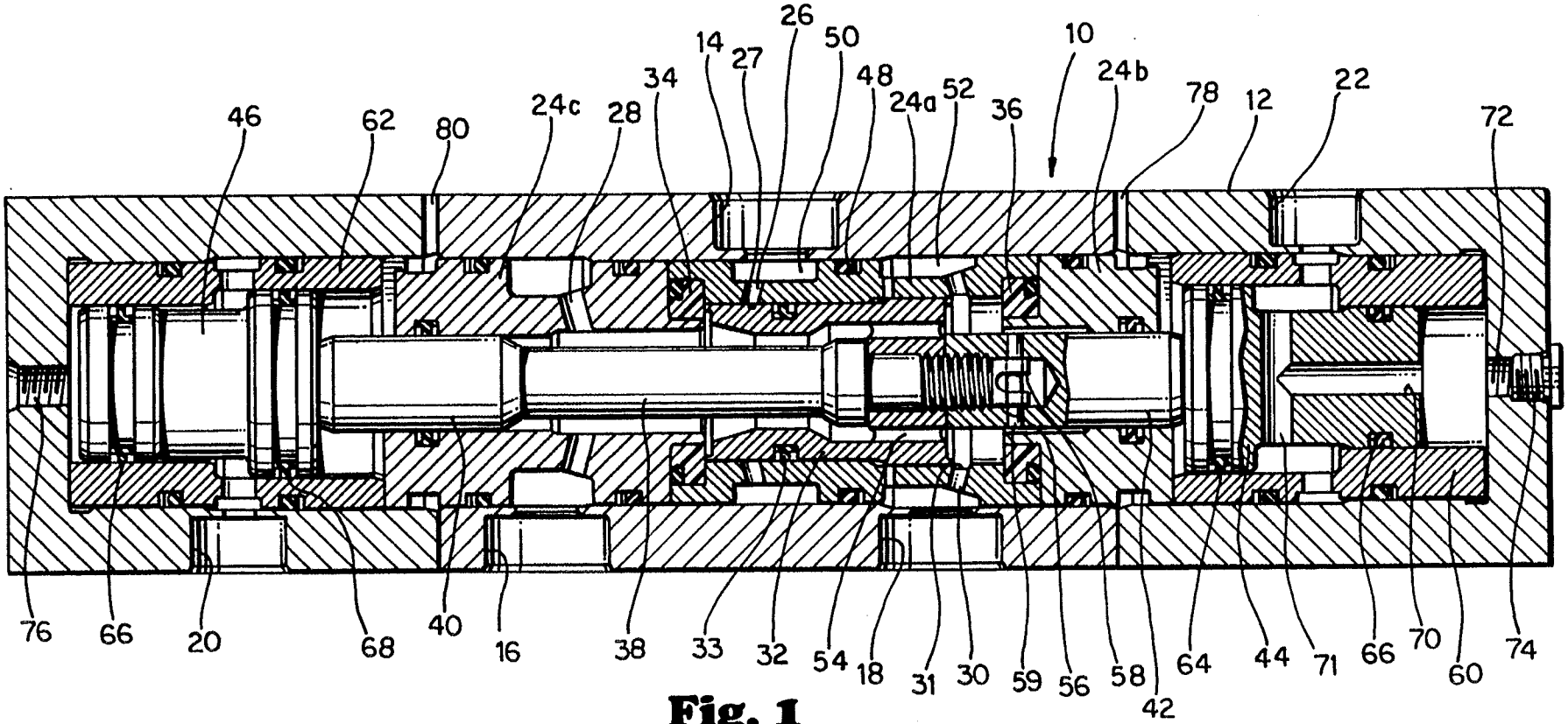
FIG. 1 is an elevational, cross-sectional view of a sequence valve of the present invention shown in the closed position.

Referring now to the drawings, and particularly to FIGS. 1–4, the reference numeral 10 generally indicates the sequence valve of the present invention and includes a housing 12 having a fluid supply port 14, an output port 16, an exhaust port 18, a pilot pressure port 20, and a bias pressure port 22. A tubular cage which includes sections 24*a*, 24*b* and 24*c* is positioned in the housing and includes a plurality of openings or slots 26 in communication with the supply port 14, a plurality of openings or slots 28 in communication with the outlet port 16, and a plurality of openings or slots 30 in communication with the exhaust port 18.

A hollow spool valve element 32 is telescopically movable in the cage section 24*a* and includes one end for alternately opening and closing the slots 26 to the supply port 14 and has another end for alternately opening and closing the slots 30 to the exhaust port 18. The spool 32 includes a seal 33 such as a T-seal around the OD of the spool which seals against the cage portion 24*a*. Poppet valve seats 34 and 36 are provided carried by the cage elements 24*a*, 24*b* and 24*c* adjacent opposite ends of the spool valve element 32 for engagement by the ends of the spool valve element 32. The seats 34 and 36 may be made of any suitable plastic material and a polyamide-imide material, such as sold under the trademark Vespel, is satisfactory and provides a soft sealing seat. A valve stem 38 having a first end 40 and a second end 42 of equal diameters sealingly engages the cage sections 24*b* and 24*c* on opposite ends of the spool valve element 32. Since the ends 40 and 42 have the same sealing diameter the pressure acting on one stem end is balanced by pressure acting on the other stem end from the ports 14, 16 and 18 and are balanced and do not add or subtract from any sealing loads or opening or closing forces.

Figure 2:
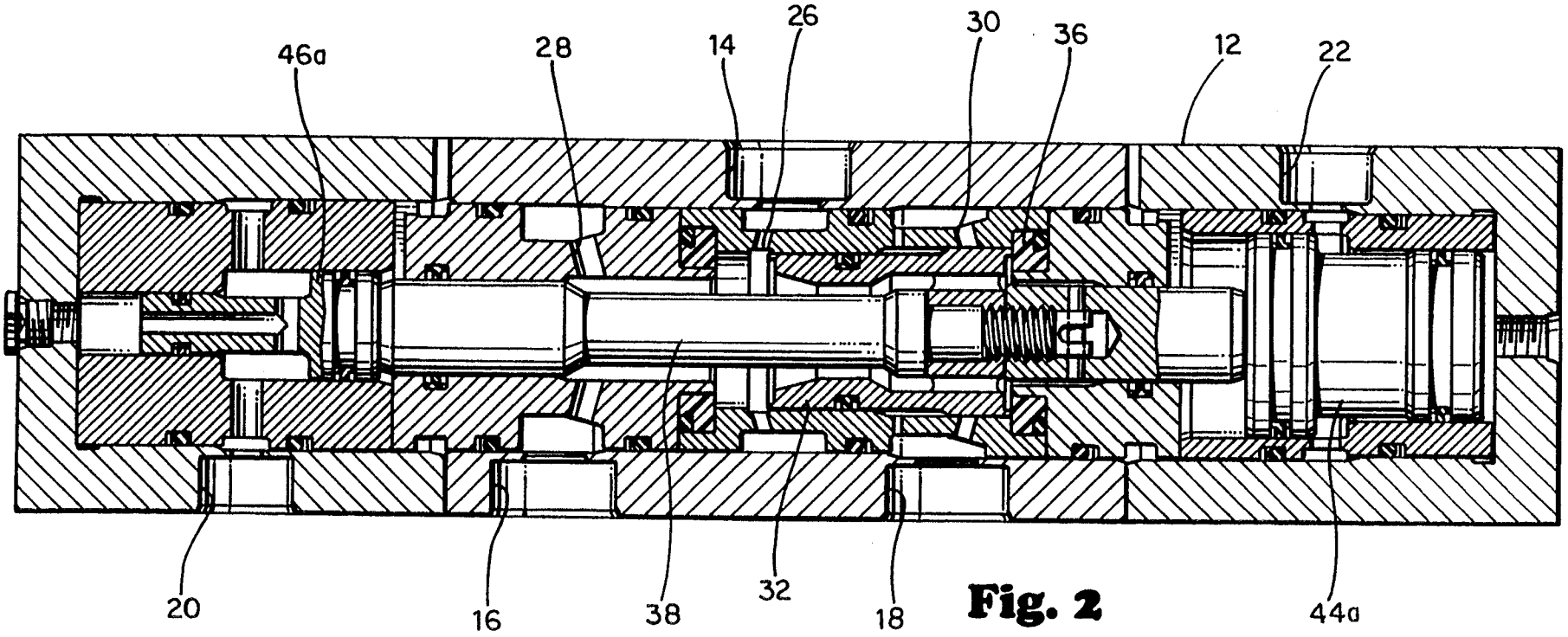
FIG. 2 is an elevational, cross-sectional view of the valve of FIG. 1 shown in the open position, but illustrating different types of bias and pilot pistons.
Figure 7:
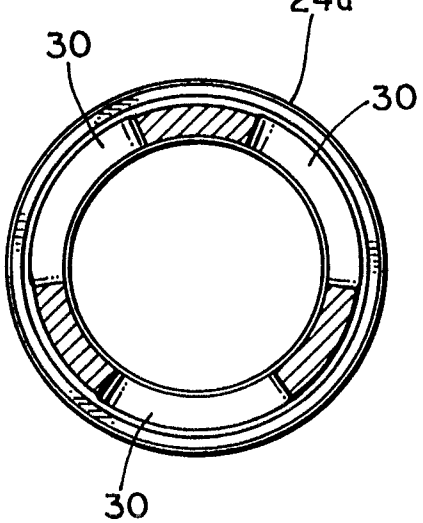
FIG. 7 is a cross-sectional view taken along the line 7—7 of FIG. 5.
Figure 5:
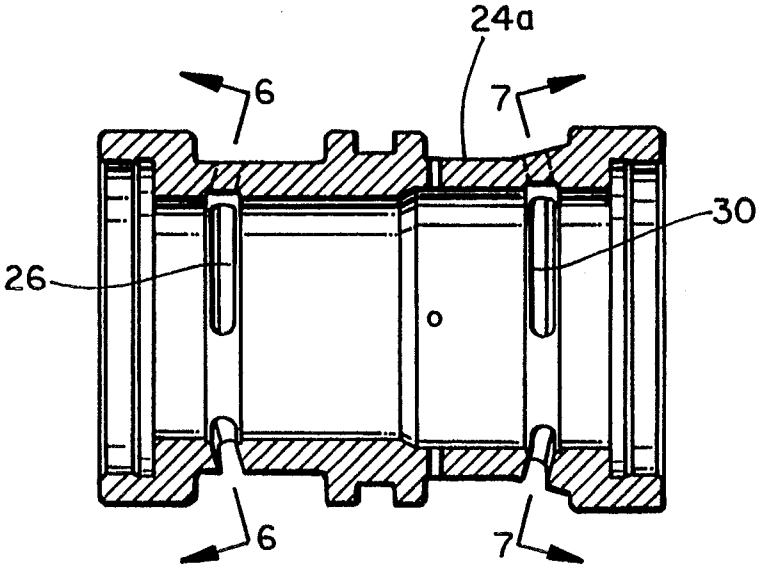
FIG. 5 is an elevational view, in cross section, of the center section of the cage of the present invention.
Figure 6:
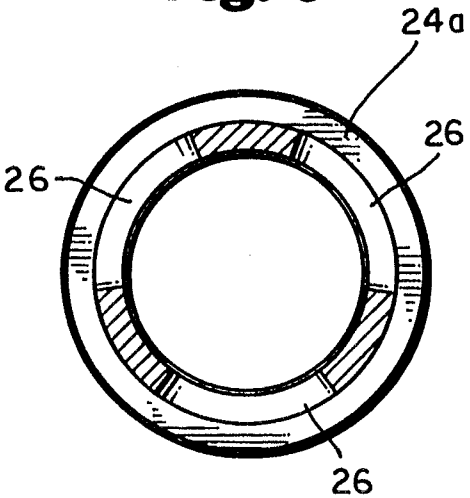
FIG. 6 is a cross-sectional view taken along the line 6—6 of FIG. 5.

A biasing piston 44 is provided in the housing 12 engaging one end, such as 42, of the valve stem 38, and is in communication and actuated by fluid pressure from the bias pressure port 22. A pilot piston 46 is provided in the housing 12 engaging the other end, such as 40, of the valve stem 38, and is in communication with and actuated by fluid pressure from the pilot pressure port 20. In FIG. 1, the valve 10 is shown in the closed position in which the bias piston 44 exerts a greater force on the valve stem 38 than the pilot piston 46. Thus, the spool valve element 32 is moved to a position wherein the spool valve 32 engages and seals against seal 34. The spool valve element 32 also covers the multiple angular spaced slots 26 in the cage 24*a* but uncovers the multiple angular spaced slots 30. (See FIGS. 5, 6 and 7.) Seal 48 separates annular fluid channels 50 and 52 which are in communication with the slots 26 and 30, respectively. Thus, the supply pressure in the port 14 is prevented from entering into the interior of the valve 10 by the spool 32. In the closed position shown, the hydraulic outlet pressure in the port 16 will flow into the valve cavity through slots 28 (which are shaped similar to slots 26 and 30) and will flow through passageways 54 in the spool 32 and out the slots 30 and out the exhaust port 18. When sufficient pressure is applied to the pilot pressure port 20, as best seen in FIG. 2, to overcome the force of the bias piston 44, the stem 38 and the spool 32 are shifted to the right to seat the spool 32 against seat 36. In this open position, the spool valve element 32 uncovers the slots 26 but covers the slots 30. Therefore, the interior of the valve to the exhaust port 18 is closed, but supply hydraulic fluid passes from the inlet port 14, through the slots 26, around the stem 38, out the slots 28 and through the outlet port 16 to operate the connected equipment.

The angularly directed slots 26 and 30 in the cage portion 24*a* each intersect an internal groove 27 and 31, respectively, at the internal diameter of the caged portion 24*a*. This is done to prevent the Bernoulii effects from trying to pull the spool 32 sideways toward any one slot as it passes by. Instead, the spool is passing by the symmetrical grooves around the perimeter. The grooves 27 and 31 balance out any side loading effects.

The stem end portion 42 is connected to the stem 38 by a connection joint connecting the two pieces. The two pieces are threaded together and fastened by a cylindrical pin 56 with rounded ends. The male portion of one stem member has fine pitch male threads and a nose portion that uses an axial slot 58 that cooperates with the pin 56 and the female stem portion to provide an adjustable connection. The stem joint is formed by screwing the stems together until they shoulder against the spool 32. The stems are unscrewed slightly until the hole 59 in the female stem lines up with the slot in the male stem and the pin 56 is installed. The slightly loose joint allows the spool 32 to float and seek its best alignment in the cage 24*a*.

Of course, in using a plurality of sequence valves 10, each of which must be operated at a different pilot pressure while using the same bias pressure, the cross-sectional areas of the pilot pistons 46 relative to the bias pistons 44 must be made different from each other. In the present invention, each of the pistons 44 and 46 are provided with an adapter sleeve. Thus, adapter sleeves 60 and 62 are provided for pistons 44 and 46 of FIG. 1. The adapter sleeves 60 and 62 are machined identically on the outside diameter and in length. However, the internal diameter bores are different. Preferably, both the bias piston 44 and the pilot piston 46 are machined to mate with two different sized bores. The length of all the pistons 44 and 46 are the same and the difference between the seal bores are sized to provide the pressure area required for the operating conditions. Thus, piston 44 has sealing rings 64 and 66 of different diameters and piston 46 has sealing rings 66 and 68 of different diameters. In some pistons, such as piston 46, the pressure area is the net annular area defined by the two seals 66 and 68. In some pistons, such as the piston 44, the full piston area is required and thus piston 44 has internal intersecting passageways 70 and 71 leading from the back end of the piston 44 to direct pressure to the rear area of the small end of the piston 44 thereby providing the full area of piston seal 44. While the seal 66 could be omitted from the smaller step diameter, since pressure is directed to both sides of the smaller diameter seal 66, it is desirable to keep both seals 64 and 66 to keep the piston 44 in proper axial alignment. It is to be noted that the ends of the body 12 have openings. The opening 72 at the back of piston 44 includes a plug 74 for preventing loss of pressure when full piston area sealing is required. On the other hand, the opening 76 behind the piston 46 is open to prevent a hydraulic lock. In addition, the chambers in front of the large end of the pistons 44 and 46 include vents 78 and 80, respectively. However, for different valves 10, the relative cross-sectional areas of the biasing piston and the pilot piston may be different. For example, see FIG. 2 in which the effective cross-sectional area of the pistons 44*a* and 46*a* have changed relative to pistons 44 and 46 in FIG. 1.

Referring now to FIG. 4, the use of double ended studs 80 and nuts 82 is used to attach each end member a central member to form body 12. Preferably, the body 12 is made from a square stock for efficiency of mounting and space. Again, in FIG. 4, a different sized pilot piston 46*b* is illustrated.

Figure 8:
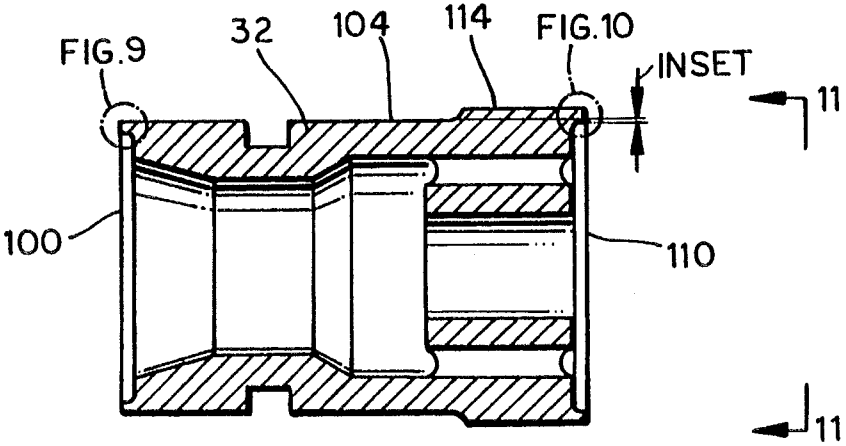
FIG. 8 is an elevational view, in cross section, of the spool valve element of the present invention.
Figure 9:
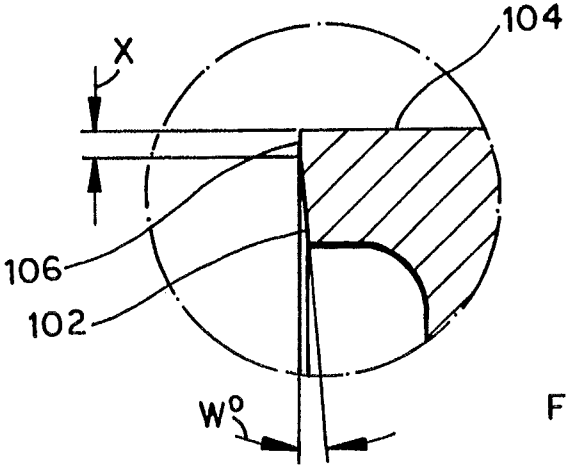
FIG. 9 is an enlarged, fragmentary cross-sectional view of the circled insert of FIG. 8.

The ends of the spool valve element 32 are important. When the valve element is in the closed position, as best seen in FIG. 1, the end or face 100 (FIGS. 8 and 9) seats against the seal 34. The end or face 100 of the spool valve 32 is the end of the spool valve element opening and close the supply port 14 and slots 26. The face 100 includes a tapered conical face 102 tapering inwardly away from the outside diameter 104 of the spool valve 32. The effect is to provide a seal point at the outside diameter 104 of the spool 32 which then has a sealing diameter equal to approximately the same diameter of the seal 33. The purpose of equalizing the diameter 104 and the seal 33 is to eliminate any pressure area from the port 16 trying to make the spool 32 seat tighter against the seal 32 in the closed position. Preferably, the face 100 includes a flat surface 106 having a distance X from the outside diameter 104. Therefore, supply pressure in the port 14 neither increases nor decreases the closing or sealing force on the face 100. Instead, the seating contact pressure force is provided by the force of the biasing piston 44.

Figure 10:
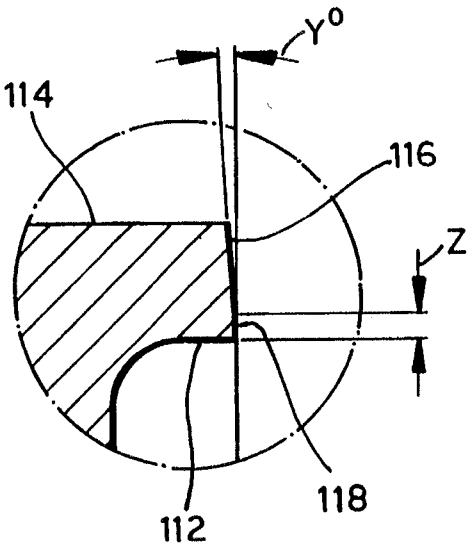
FIG. 10 is an enlarged, fragmentary cross-sectional view of the circled insert of the other end of the spool valve element.
Figure 11:
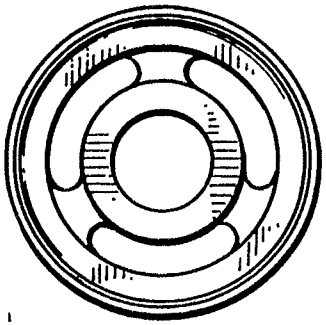
FIG. 11 is an end view taken along the line 11—11 of FIG. 8.

Referring now to FIG. 2, the spool valve element has a face end 110 which seals against the seal 36. The forces involved and the configuration of the face 110 is more complex. Preferably, the ID 112 (FIG. 10) of the sealing face is slightly smaller than the seal diameter 104 of the spool defined by the seal 33. Therefore, in the open position the spool 32 is affected by the pressure at the supply 14 and slots 27 acting against the seal 33 to add to the sealing contact pressure of the spool 32 against seal 36 when the valve is fully opened. This is desirable to have an additional pressure assisted sealing force, particularly for those valves 10 in which the pilot piston 46 must shift and seat the valve 10 at low pilot pressures, such as 500 psi. Generally, the seal contact pressure at the face 110 of the spool 32 must exceed the internal supply pressure by a seating factor of approximately 1.5 times the supply pressure. Therefore, by providing a seating surface at the ID 112, additional pressure assisted seating force is provided.

However, the pilot pressure will continue to increase as additional sequence valves are actuated to a high pressure, such as 3000 psi, before the entire operating sequence is stopped. Thus, the pilot pressure will increase six times and the seat contact pressure of the spool face 110 against seal 36 would increase six times as well. This is not desirable with a soft seat plastic material. Therefore, the sealing face 110 has an OD 114 which is larger in diameter than the nominal OD 104 of the valve. In addition, the face 110 of the end of the spool valve 32 which opens and closes the exhaust port includes a tapered conical face 116 tapering inwardly away from the internal diameter 112 of the face. Furthermore, the face 110 includes a flat surface 118 at the inside diameter 112 for a distance Z. Therefore, the seat area of contact of the face 110 with the seat 36 will increase with increasing pilot pressure to keep the seat contact stress within desirable limits. While the overall seat area of face 110 is larger than the seating area of the face 100 at the other end of the spool 32, the enlarged face seating area 110 extends into the exhaust portion of the valve and is acted upon only by environmental pressure which has little effect on the seating contact pressure.

The present invention, therefore, is well adapted to carry out the objects and attain the ends and advantages mentioned, as well as others inherent therein. While presently preferred embodiments of the invention have been given for the purpose of disclosure, numerous changes in the details of construction and arrangement of parts will readily suggest themselves to those skilled in the art and which are encompassed within the spirit of the invention and the scope of the appended claims.

What is claimed is:

1. A springless, pilot operated sequence valve providing a two position three way valve comprising, a housing having a supply port, an output port, an exhaust port, a pilot pressure port and a bias pressure port, a tubular cage positioned in the housing having openings in communication with each of a supply port, output port and exhaust port, a hollow spool valve element telescopically movable in the cage having one end for alternately opening and closing the supply port, and having another end for alternately opening and closing the exhaust port, a poppet valve seat carried by the cage adjacent each end of the spool valve for engagement by the spool valve element, a valve stem connected to the spool valve, said valve stem having first and second ends of equal diameter sealingly engaging the cage on opposite ends of the spool valve, a biasing piston in the housing engaging one end of the valve stem and in communication with the bias pressure port, and a pilot piston in the housing engaging the other end of the valve stem and in communication with the pilot pressure port.

2. The sequence valve of claim 1 wherein said biasing piston and said pilot piston each include two piston rings of different diameters.

3. The sequence valve of claim 2 wherein one of said pistons includes an internal passageway from one end of the piston to an external opening between the piston rings.

4. The sequence valve of claim 1 wherein the end of the spool valve element opening and closing the supply port includes, a tapered conical face tapering inwardly away from the outside diameter of the spool.

5. The valve of claim 4 wherein said end of the spool valve element includes a flat surface at the outside diameter of the spool.

6. The sequence valve of claim 1 wherein the end of the spool valve opening and closing the exhaust port includes, a face having an internal diameter less than the outside diameter of the spool and includes a tapered conical face tapering inwardly away from the internal diameter of the face.

7. The valve of claim 6 wherein the end of the spool valve element includes a flat surface at the inside diameter of the spool.

8. The valve of claim 6 wherein the end of the spool valve element includes an enlarged outside diameter.

* * * * *

UNITED STATES PATENT AND TRADEMARK OFFICE

CERTIFICATE OF CORRECTION

PATENT NO. : 5,409,040

DATED : April 25, 1995

INVENTOR(S) : Tomlin

It is certified that error appears in the above-indentified patent and that said Letters Patent is hereby corrected as shown below:

Column 2, line 13, change "fiat" to -- flat --.
Column 5, line 3, change "fiat" to -- flat --.
Column 5, line 41, change "fiat" to -- flat --.
Column 6, claim 7, line 54, change "fiat" to -- flat --.

Signed and Sealed this

Fourth Day of June, 1996

*Attest:*

Bruce Lehman

BRUCE LEHMAN

*Attesting Officer*

*Commissioner of Patents and Trademarks*